US006553589B1

(12) United States Patent
Hartman

(10) Patent No.: US 6,553,589 B1
(45) Date of Patent: Apr. 29, 2003

(54) INFANT BASKET FOR SIDE SLEEPING SUPPORT

(75) Inventor: Dorothy M. Hartman, 1105-C South St., Philadelphia, PA (US) 19147

(73) Assignee: Dorothy M. Hartman, Philadelphia, PA (US)

( * ) Notice: Subject to any disclaimer, the term of this patent is extended or adjusted under 35 U.S.C. 154(b) by 0 days.

(21) Appl. No.: 09/556,106

(22) Filed: Apr. 21, 2000

Related U.S. Application Data

(63) Continuation-in-part of application No. 09/024,736, filed on Feb. 17, 1998, now abandoned.

(51) Int. Cl.[7] ..... A47C 20/00
(52) U.S. Cl. ..... 5/655; 5/101
(58) Field of Search ..... 5/655, 101, 603, 5/98.3, 632, 648

(56) References Cited

U.S. PATENT DOCUMENTS 1,203,080 A * 10/1916 Vanek ..... 5/105
1,386,236 A * 8/1921 Chambers ..... 280/29
3,096,917 A * 7/1963 Gudiksen ..... 5/655
4,251,890 A * 2/1981 Dainty, Jr. ..... 5/103
5,522,104 A * 6/1996 Little ..... 5/632
5,836,653 A * 11/1998 Albecker ..... 5/632

* cited by examiner

*Primary Examiner*—Anthony Knight
*Assistant Examiner*—Fredrick Conley
(74) *Attorney, Agent, or Firm*—Robert B. Famiglio, Esq.

(57) ABSTRACT

A carrying structure for support of an infant which cradles the infant in a preferred sleeping position. The infant is supported within a basket structure in which a curved board and cushion combination provide a resting surface which is at an angle to a base which is fixed to the main basket which comprises the body of the device. By supporting an infant's sleeping position such that the infant cannot lye flat on its back, danger of asphyxiation of a young infant is greatly reduced. The disclosed infant carrying basket addresses one of the suspected causes of Sudden Infant Death Syndrome by presenting a resting surface which urges the infant to remain in an off-level position, essentially sleeping partially on one of their sides.

6 Claims, 4 Drawing Sheets

INFANT BASKET FOR SIDE SLEEPING SUPPORT

RELATED APPLICATIONS

This application is a continuation in-part of the inventors earlier filed U.S. application Ser. No. 09/024,736, filed on Feb. 17, 1998 now abandonded.

FIELD OF THE INVENTION

This invention relates to a bolster structure for supporting a sleeping infant on its side. The present invention is an infant carrying or sleeping basket integrated with a carry handle and resting base to maintain stability of the basket and provide for a safe means to carry an infant. The disclosed invention provides a support mechanism related to means to prevent Sudden Infant Death Syndrome.

BACKGROUND OF THE INVENTION

Much attention has been given to ways to reduce a risk of dying from Sudden Infant Death Syndrome, an affliction which threatens infants who have died in their sleep for heretofore unknown reasons. Many different explanations for this syndrome and ways to prevent the syndrome are found in the literature. It is thought that infants which sleep on their backs may be at risk of death because of the danger of formula regurgitation and liquid aspiration into the lungs. It has been thought that infants of six (6) months or less do not have the motor skills or body muscular development to regulate movements responsive to correcting breathing problems that may occur during sleep. Rolled blankets have been used behind the back of an infant to position the infant in an other than flat position, by biasing the infant to the left or to the right of a flat, level position. Blankets or other cushions temporarily placed in a crib are unsatisfactory for infant side support, because the blanket may unroll or the support structure may be pushed out of the way by movement of the infant. A structure is needed which is more permanent in nature to support an infant on its side while sleeping. The present invention describes a positioning structure which is integrated into a carrying basket which also is itself integrated into a base to provide for leveling of the device on any surface, be it a table, floor, car seat or even within an existing crib.

DESCRIPTION OF THE PRIOR ART

The prior art provides many different infant support and positioning systems which are generally adapted to the safe carrying of an infant on a transportation device, be it a bicycle, backpack, or infant car seat. With respect to devices which are designed to allow an infant to rest on its side, there is a less developed array of inventions which are available to teach just how to present an infant support system aimed at reducing Sudden Infant Death Syndrome.

U.S. Pat. No. 4,733,836 issued to Barnes on Mar. 29, 1988 teaches a nursing bottle holder mechanism to reduce the chances of choking which provide for a level surface which is inclined at an angle to position the child generally on its side. Barnes teaches the use of such angling to prevent choking of the child while it is feeding from a bottle. Barnes does not teach a carrying mechanism, and also provides two flat surfaces which intersect at an angle, allowing the child to slip to one side more easily than with the motion taught in the present invention.

U.S. Pat. No. 5,341,531 issued to Straub, et al. on Aug. 30, 1994 presents a specific device designed to prevent Sudden Infant Death Syndrome by teaching a bolster structure for infant side sleeping. Straub shows sharply angled surfaces that are used to wedge an infant between two bolsters to prevent the child from rolling in either direction. The invention taught in Straub is not designed for a carrying device, is not easily mobile and appears to have been designed to present a infant position and control mechanism for a flat surface such as an existing bed or crib.

The present invention as described below is designed to overcome certain limitations found in the prior art. The disclosed invention provides a useful integration of a structure to hold a child at an angled position while providing for a reference base and a carry mechanism and structure to allow the child to be transitioned from a resting area to being transported by arm to another location without the need to rouse the child or reposition the child in the carrying structure of the invention.

SUMMARY OF THE INVENTION

The present invention is directed to structures for securing an infant to rest in a position that will avoid the suspected causes of Sudden Infant Death Syndrome. The structure uses a basket with an integrated base design and an internally affixed inclined board or platform which positions the infant at a preferred angle from a normally prone position. The structure utilizes an internal support device to urge the infant to sleep on one of its sides such as to allow easier breathing and to avoid aspiration of regurgitated formula.

In the preferred embodiment, an inclined platform is integrated into a swaddling basket, the entire structure being either permanently or temporarily affixed to a base which provides that the basket always rest in an upright position—thereby assuring that the internal platform within the basket is at an angle of between 20 and 35 degrees when measured from the ground and direction of gravity.

An important feature of the present invention is that the invention is fabricated from commonly found materials and a minimal amount of components. All the components necessary to build and use the present invention are found in even many poor countries of the world, thereby making the invention available at a lower cost. The invention as described is inexpensive to build and may be built from wicker, wood, plastic and even other woven materials. Any material which could be used to build a conventional infant swaddling basket may also be used to build the present invention.

The invention consists of an almost egg shaped basket wherein at least one end is open to allow the child's head to extend beyond a covering which may be used in certain versions of the basket's design. While not necessary, the basket itself could also present a cover over the top of the basket to act as a shelter for the child and may be attached to a handle which will allow the entire basket to be carried or placed on the ground in a resting position as in with a common basinet.

The entire design can be durable and long lasting. If desired, it can be cleaned by conventional methods when soiled and any cushioning placed within the internal inclined platform can be removable and cleaned separately.

Accordingly, it is the object of the present invention to provide a swaddling basket for the purpose of protecting very young infants, zero to nine months of age, from accidental death caused by suffocation during sleep. It is a further object of the present invention to provide a swaddling basket which supports an infant in an angled sleeping position by providing passive restraints to the infant's motion by holding a baby on its side during sleep by utilizing an angled platform in combination with a curved surface integrated into a infant basket. It is further the object of the present invention to provide an infant carrying basket which provides a mechanism to hold an infant in a preferred position for sleeping or resting which may transition from a resting position in a bed or crib to a carrying basket without reconfiguration.

DETAILED DESCRIPTION OF THE PREFERRED EMBODIMENT

Figure 1:
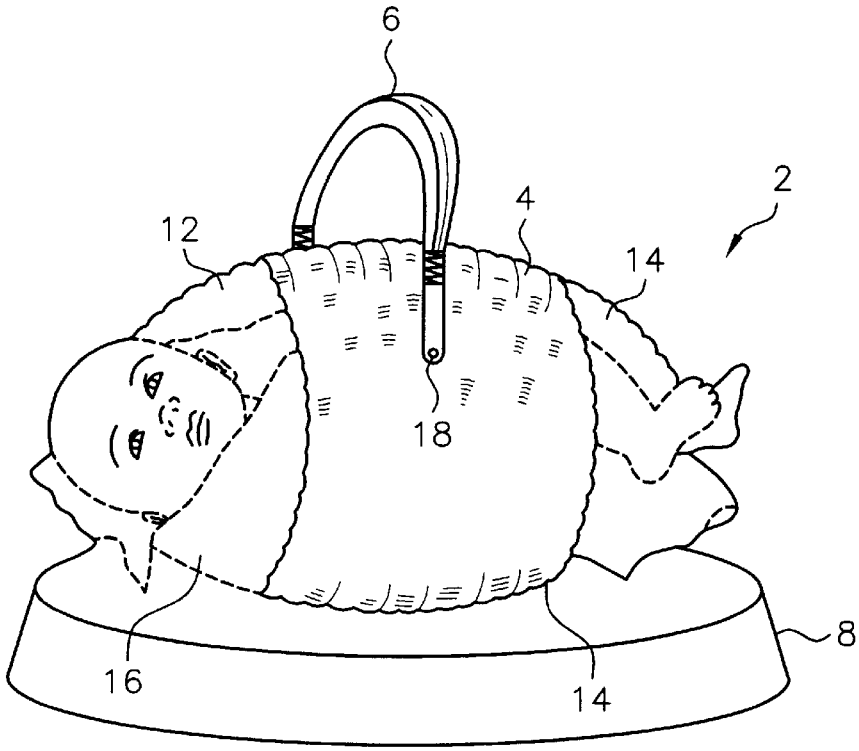
FIG. 1 is a pictorial view of one embodiment of the infant carrying basket showing the carrying basket opened on both ends.
Figure 2:
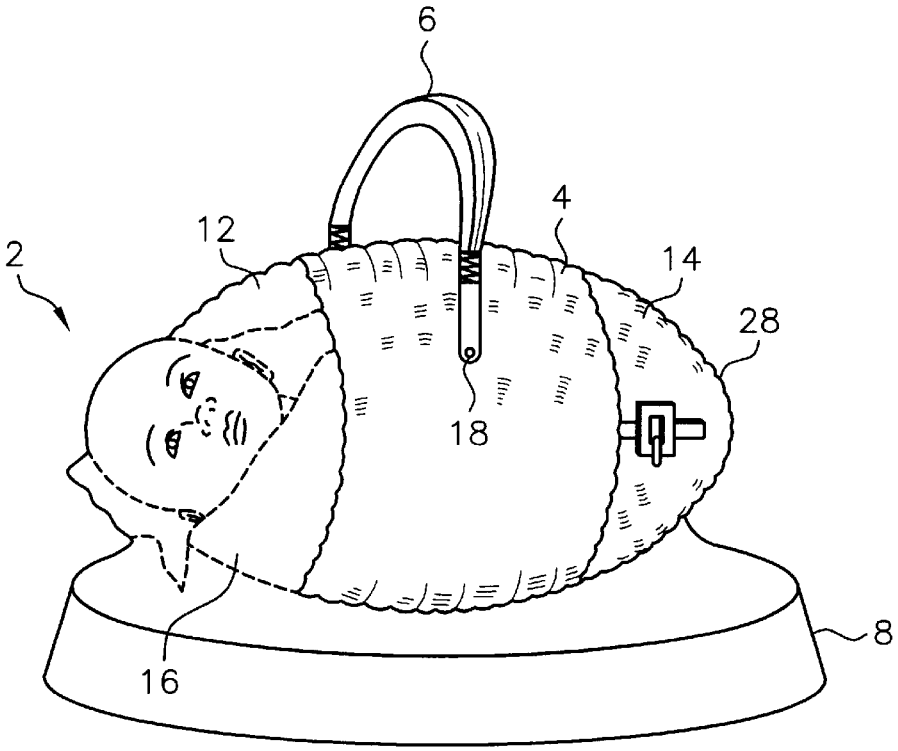
FIG. 2 is a pictorial view of the present invention showing the infant carrying basket with a removable end cover in the attached position.

A detailed of the preferred embodiment would now be provided with reference to the various drawings wherein like numbers refer to like parts. Turning to FIG. 1, a typical embodiment of the disclosed invention is presented in its entirety. Basket 2 is resting on base 8 which keeps the basket in an upright position in the event that the infant placed within the basket should squirm or attempt to move. The major components of basket 2 are comprised of the basket frame 4, basket handle 6, basket base 8, internal support frame or board 20, and basket cushion 10. Basket 2 may be manufactured from many commonly available materials, including wicker, modern plastics and composite materials, or even shaped wood viners if desired. Basket frame 4 is a conventional infant swaddling basket in design to the extent that it is generally egg shaped, is sized to accommodate infants from newborn to perhaps six to twelve months old or more depending on the desired range of uses. Along its major axis, basket 2 has a first opening at end 12 and a second opening at end 14 as illustrated. It is possible to have asymmetrical sides to basket frame 4 allowing for the sides of egg shaped basket frame 4 to extend on the horizontal axis of basket 2 further on one side of the basket, providing additional protection and perhaps support for the infant occupying the basket. Such asymmetrical design, though not crucial to the thrust of the present invention may be preferred by some users and are illustrated in both FIG. 1 and FIG. 2.

Figure 6:
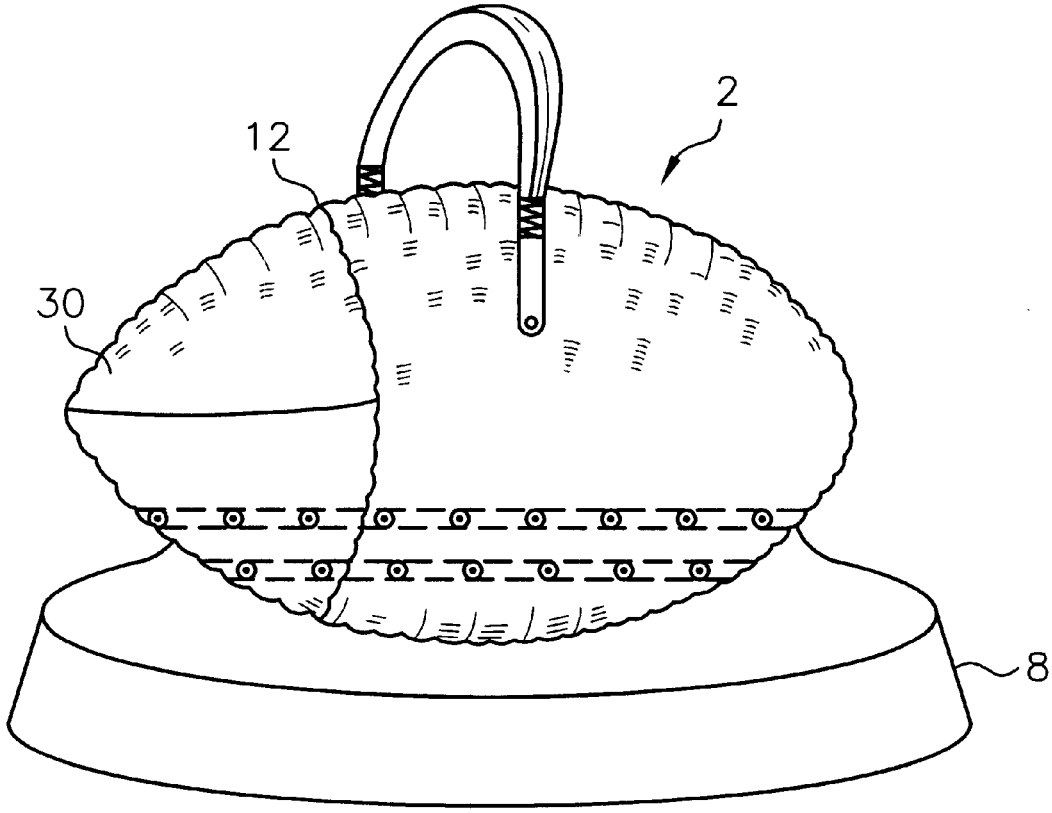
FIG. 6 is a view of the present invention illustrating an embodiment which allows for a cover mechanism to provide for a completely enclosed infant carrying basket.

A simpler design with only a first open end 12 is suggested in FIG. 6. FIG. 6 illustrates an embodiment of the present invention which includes a first end cover 30 which can be used to cover a first opened end of basket 2 to provide for shelter for the infant occupying the basket in the event that the basket is being used to transport an infant in inclement weather or to otherwise shade the infant being carried from ultraviolet light from the sun in appropriate circumstances.

Figure 3:
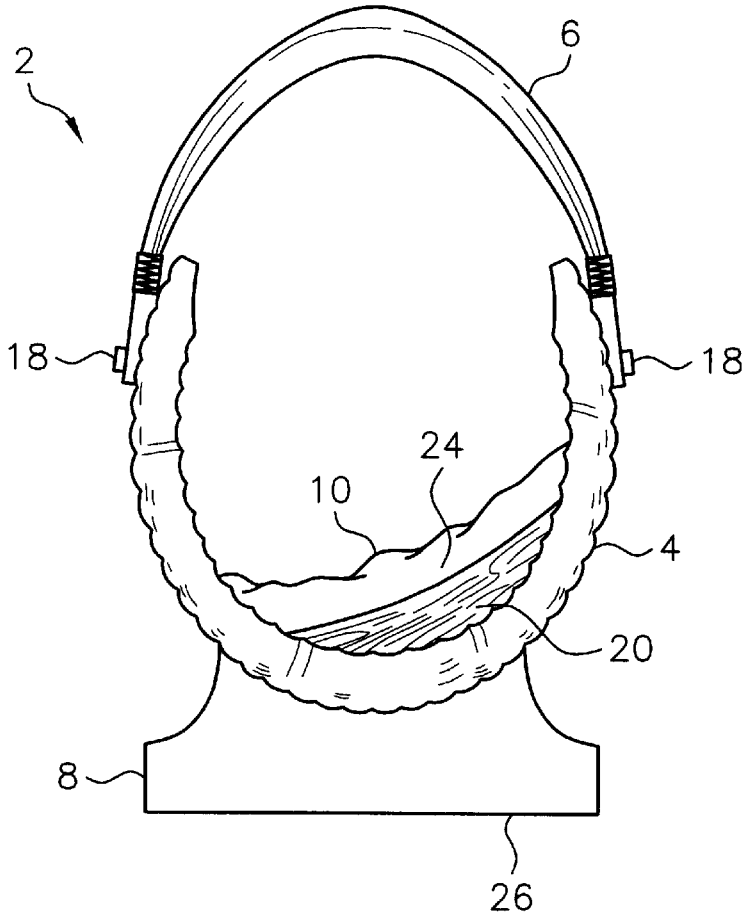
FIG. 3 is an end view of the infant carrying basket illustrating the relative position of all the major components of the basket, and a support platform at approximately 22 degrees from horizontal.

Turning to FIG. 3, an end view of the infant carrying basket is shown in cross section. From this end view, it can be appreciated that the major thrust of the present invention is the presentation of an angled platform for the infant to rest upon when utilizing the basket. Support frame or board 20 shown in FIG. 3 and FIG. 4, is affixed to basket frame 4 at in an off-center position, creating an asymmetrical platform upon which the infant rests.

It is essential to the present invention that the sleeping surface prevent the infant from resting or sleeping in a prone position in which the infant would essentially be perpendicular to the direction of the pull of gravity. By presenting an asymmetrical bottom area of basket frame 4, the infant is urged to rest on one side, presenting the infant's face and upper body torso in a sideway looking position as suggested in both FIG. 1 and FIG. 2. It can be seen in FIG. 3 that board 20 has a slightly curved surface 24 which presents a more comfortable resting surface for the infant occupying the basket. Naturally, the frame or board 20 can be softened by applying cushion 10 on top of the curved surface 24 allowing for a softer surface for the infant, while still presenting the advantage of an asymmetrical resting area to urge the infant to rest on one of its sides. In the invention shown, the infant would not normally be able to roll on its side in a direction which would be considered essentially uphill, and against the pull of gravity.

It is believed that the optimal angle for board 20, when compared to the horizontal direction, should be between 20 and 35 degrees. The precise angle is not necessarily crucial, since the object is to present an asymmetrical resting surface for infant's of various sizes and weights. It is believed that the board angle 22 can be varied over the range indicated with optimal effect and will achieve the desired results of preventing the infant within the basket from resting in a position in which its back is perpendicular to the direction of the pull of gravity.

Figure 4:
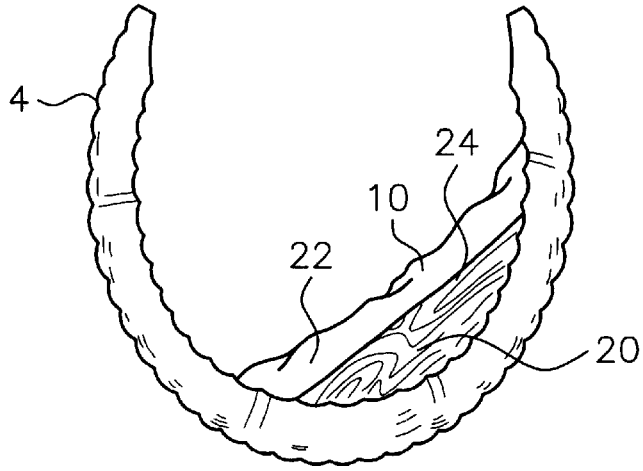
FIG. 4 is an end view showing only the basket structure, internal angled platform and a cushion angled at approximately 35 degrees from horizontal.

The cross-section of basket 2 shown in FIG. 3 and FIG. 4 is a basket design which has an open top. It can be appreciated that basket frame 4 can be continuous as shown in other figures, or can be an open air style as suggested in FIG. 3 and FIG. 4. The function of the invention would be the same as those skilled in the art would quickly recognize. It is also important to note that the present invention as disclosed can be used for either left hand or right hand side sleeping depending on the preference of the user. In observing FIG. 1, for example, the infant pictured within basket 2 could be positioned within the basket such as to be positioned facing left as opposed to the infants right side as shown both in FIG. 1 and FIG. 2. An advantage of the invention is that while obtaining the benefit of the side sleeping support discussed, one can also vary the position of the infant, facing either left or right, thereby allowing a balance of positioning depending on the preference of the user. Though not specifically thought to be a problem, it would be appreciated that rotating the position of the infant, from time to time during use of basket 2, might be advisable such that an infant experiences side or back pressure when sleeping equally on its left and right side.

Figure 5:
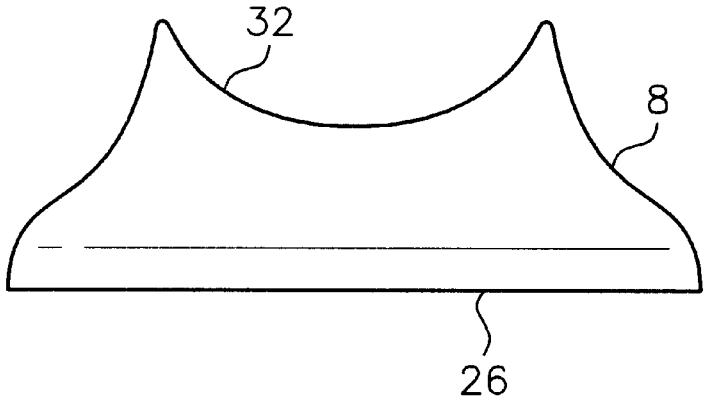
FIG. 5 is an illustration of a detachable base used to support the infant carrying basket in an upright position.

For the convenience of the user, and for additional safety and comfort of the infant, base 8 shown separately in FIG. 5 can be fashioned out of any material and is sized to accept the bottom area of basket frame 4. Basket base 8 rests upon this bottom plate 26, which for stability purposes is shown wider at bottom 26 than the top area of base 8. While base 8 is not required for the invention to function properly, it is believed that it will add function to basket 2 by allowing the basket to rest in a firm, secure position while on a bed, crib, car seat or other surface when not being carried.

It can also be appreciated that base 8 can be permanently affixed to basket frame 4 by conventional means, including straps, gluing or other conventional fastening means to make base 8 a permanent part of the basket frame 4 and the entire basket 2. If base 8 is made of a light enough material, such as impact plastic or other composite materials, it likely would not add significant weight to basket 2 thereby allowing it to be permanently affixed if so desired for convenience. If unattached, the bottom of the basket should fit snugly in the concave base top 32 as shown in FIG. 5. Using the detached version of base 8, the resting angle of basket frame 4 can be slightly adjusted in the event that base 8 is resting upon a non-level surface at any point.

For convenience sake, the basket frame 4 is attached to handle 6 which is conventional in the design and affixed to the basket frame by handle fasteners 18. Such fasteners may be conventional bolts or screw designs appropriately protected with soft coverings in the interior to prevent the protruding of any metal components or other undesirable parts. If desired, fasteners 18 can be of the type which allow rotation about their axis so that the basket may be free to swing under the handle if desired by the user.

It can be appreciated that the support board 20 does not necessarily have to be asymmetrical in its location in the bottom area of basket frame 4. If desired, support board 20 may be symmetrical in the area that it contacts frame 4 but asymmetrical at its upper location along its curved surface 24. The objective in the present invention can be achieved as long as a resting surface for the infant is presented asymmetrically to the direction of the pull of gravity for the basket, specifically the downward direction, so that the infant would not naturally tend to roll over or to remain in the position in which its back is parallel to the ground.

Figure 7:
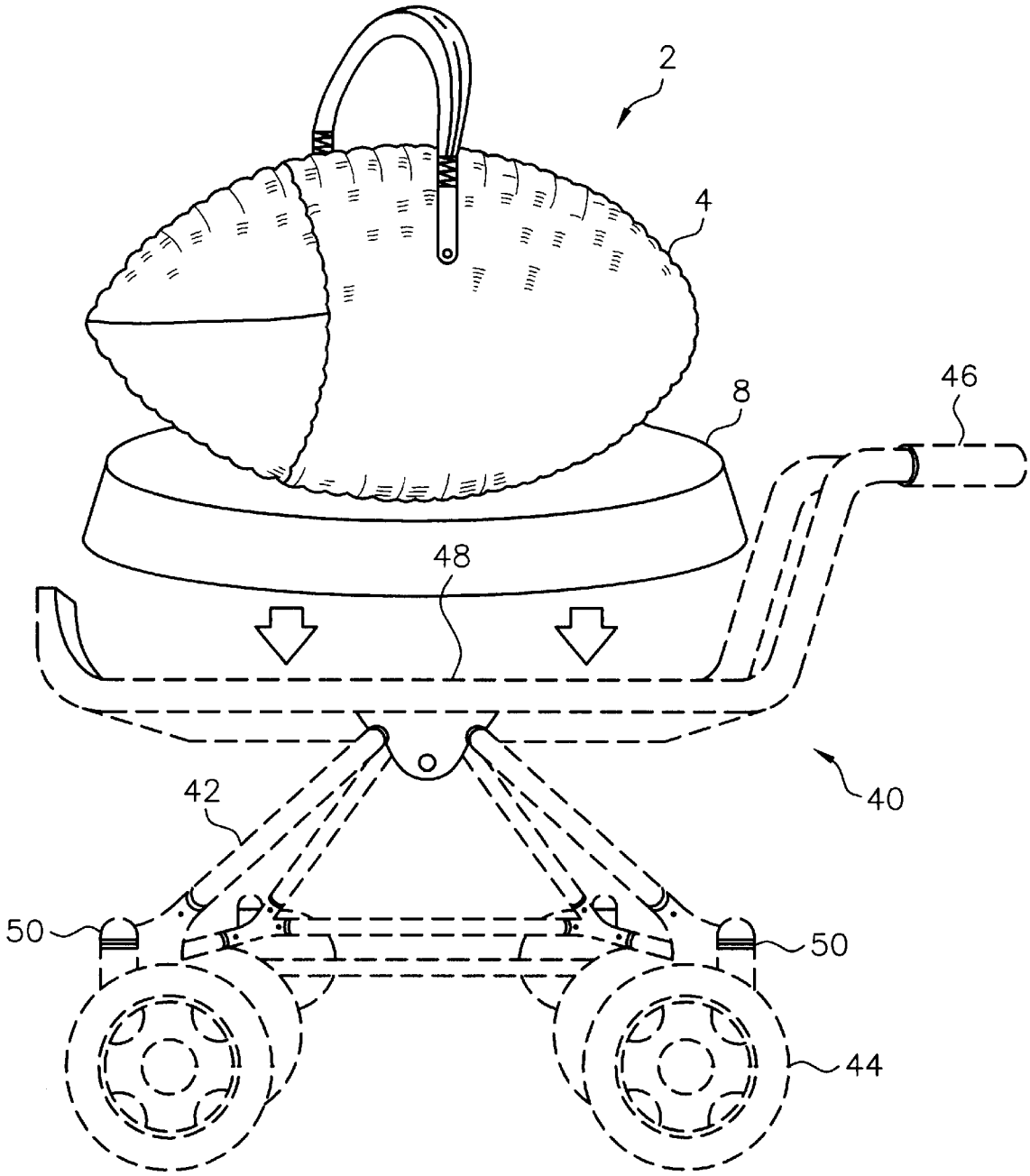
FIG. 7 is a ghosted view of a wheeled cart support mechanism which mates with the basket structure.

FIG. 7 shows the invention, along with its associated base in its preferred embodiment as it would be situated on basket cart 40 designed to adapt the basket 2 to a device which converts the basket into a baby carriage-like device. As can be seen by considering the view depicted in FIG. 7, wherein the basket cart 40 is shown in a ghosted view, basket 2 affixed to base 8 may be placed on cart based shelf 48 which can be fashioned to mate with the size and dimensions of base 8. Cart 40 is comprised of frame 42 which supports shelf 48 with integral handles 46 used to propel the cart in a conventional fashion. Cart frame wheels 44 are conventional in design and placement. Wheels 44 can be designed as conventional wheel castors such as to rotate independently about the access of pin 50 which is attached to the axil of wheels 44.

Although the invention has been described with specific embodiments and examples, these teachings are not limited thereto, and modifications will likely occur to those skilled in the art without departing from the spirit and scope of this invention. Therefore, such modifications or adjustments within the scope of this invention are considered to be included.

What is claimed is:

1. A basket structure for infant side sleeping support and postioning comprising, a basket, a handle, a base and a bottom board between the infant and the base, wherein the width of said base extends outwardly beyond the width of said basket and wherein the bottom board has inclined along the longitudinal axis with respect to the horizontal resting position of said base to support the infant in lateral recumbency, that is lying on its side.

2. The basket structure for infant side sleeping support and positioning of claim 1 further comprising:

said base adapted for placement upon a surface and;

said base having a concave top adapted such that the said bottom of said basket fits within the concave top allowing the resting angle of said basket to be adjusted to maintain the infant in lateral recumbency in the event that said base is placed upon a non-level surface.

3. The basket structure for infant side sleeping support and positioning of claim 1 further comprising:

said base adapted for placement upon a surface and;

said base being permanently affixed to said basket structure.

4. A basket structure for infant side sleeping support and postioning comprising, a basket, a handle, a base and a bottom board between the infant and the base, wherein the width of said base extends outwardly beyond the width of said basket and wherein the bottom board has a slightly concave surface along the longitudinal axis and is inclined along the longitiudinal axis with respect to the horizontal resting position of said base to support the infant in lateral recumbency.

5. The basket structure for infant side sleeping support and positioning of claim 4 further comprising:

said base adapted for placement upon a surface and;

said base having a concave top adapted such that the said bottom of said basket fits within the concave top allowing the resting angle of said basket to be adjusted to maintain the infant in lateral recumbency in the even that said base is placed upon a non-level surface.

6. The basket structure for infant side sleeping support and positioning of claim further comprising:

said base adapted for placement upon a surface and;

said base being permanently affixed to said basket structure.

* * * * *